US009127900B2

(12) United States Patent
Hudson et al.

(10) Patent No.: US 9,127,900 B2
(45) Date of Patent: Sep. 8, 2015

(54) LAUNCHER DEVICE FOR LAUNCHING A SERIES OF ITEMS INTO A SPIN

(71) Applicants: Jon Hudson, Woodland Hills, CA (US); Dominic Laurienzo, Los Angeles, CA (US); Dennis Lee Chi Wai, Hong Kong (CN); Timmy Tsui Ka Tim, Hong Kong (CN)

(72) Inventors: Jon Hudson, Woodland Hills, CA (US); Dominic Laurienzo, Los Angeles, CA (US); Dennis Lee Chi Wai, Hong Kong (CN); Timmy Tsui Ka Tim, Hong Kong (CN)

(73) Assignee: JAKKS Pacific, Inc., Santa Monica, CA (US)

( * ) Notice: Subject to any disclaimer, the term of this patent is extended or adjusted under 35 U.S.C. 154(b) by 85 days.

(21) Appl. No.: 13/626,809

(22) Filed: Sep. 25, 2012

(65) Prior Publication Data

US 2013/0078885 A1 Mar. 28, 2013

Related U.S. Application Data

(60) Provisional application No. 61/540,458, filed on Sep. 28, 2011.

(51) Int. Cl.

| | |
|---|---|
| ***A63H 1/02*** | (2006.01) |
| ***F41B 7/08*** | (2006.01) |
| ***A63H 17/00*** | (2006.01) |

(52) U.S. Cl.

CPC ..... *F41B 7/08* (2013.01); *A63H 17/008* (2013.01)

(58) Field of Classification Search

CPC .... A63H 27/00; A63H 27/14; A63H 2027/00

USPC ..... 446/236, 239, 241, 255, 256, 259, 262

See application file for complete search history.

(56) References Cited

U.S. PATENT DOCUMENTS

| | | | | |
|---|---|---|---|---|
| 3,018,584 | A * | 1/1962 | Passariello | 446/259 |
| 4,016,854 | A * | 4/1977 | Lehman | 124/27 |
| 4,059,089 | A | 11/1977 | Lehman | |
| 4,452,007 | A * | 6/1984 | Martin | 446/45 |
| 4,689,034 | A | 8/1987 | Dubois | |
| 5,122,089 | A | 6/1992 | Haran | |
| 5,169,354 | A | 12/1992 | Norton | |
| 5,453,036 | A | 9/1995 | Wisznia | |
| 5,593,338 | A | 1/1997 | Itoh et al. | |
| 5,683,284 | A | 11/1997 | Christen | |

(Continued)

FOREIGN PATENT DOCUMENTS

| | | |
|---|---|---|
| EP | 0296294 | 12/1988 |
| FR | 2591905 | 6/1987 |

(Continued)

OTHER PUBLICATIONS

PCT Intenational Search Report and The Written Opinion of the International Searching Authority for PCT/US2012/058031.

(Continued)

*Primary Examiner* — Kurt Fernstrom

(74) *Attorney, Agent, or Firm* — Tope-McKay & Associates

(57) ABSTRACT

A toy launcher that can launch multiple consecutive devices into a spin is described. The toy launcher includes a housing adapted to receive an item to be launched. The housing includes a bunching mechanism to force the item from the launcher. Additionally, a protrusion is positioned in front of the launching mechanism such that art item launched from the launching mechanism engages with the protrusion, forcing the item into a spin as it exits the launcher.

2 Claims, 9 Drawing Sheets

(56) References Cited

U.S. PATENT DOCUMENTS

| | | | | |
|---|---|---|---|---|
| 6,312,306 | B1 | 11/2001 | Kroll | |
| 6,364,734 | B1 | 4/2002 | Ng | |
| 6,458,008 | B1 | 10/2002 | Hyneman | |
| 6,485,017 | B1 | 11/2002 | Ng | |
| 6,500,042 | B1 * | 12/2002 | LaPointe | 446/64 |
| 6,548,982 | B1 | 4/2003 | Papanikolpoulos | |
| 6,612,895 | B2 | 9/2003 | Sze | |
| 6,626,729 | B2 | 9/2003 | Osawa | |
| 6,648,647 | B2 | 11/2003 | Wood | |
| 6,761,612 | B1 | 7/2004 | Pencil | |
| 6,988,927 | B2 | 1/2006 | Gingold | |
| 7,063,589 | B2 | 6/2006 | Matsukawa et al. | |
| 7,427,225 | B2 | 9/2008 | Matsukawa et al. | |
| 8,388,405 | B2 * | 3/2013 | Desent et al. | 446/429 |
| 2002/0102903 | A1 | 8/2002 | Coleman | |
| 2003/0129920 | A1 | 7/2003 | Sze | |
| 2003/0134562 | A1 * | 7/2003 | Lee | 446/63 |
| 2006/0128253 | A1 * | 6/2006 | Silverglate et al. | 446/63 |
| 2006/0260594 | A1 | 11/2006 | Andersen | |
| 2007/0021029 | A1 | 1/2007 | Weidetz et al. | |
| 2007/0205554 | A1 | 9/2007 | Elliott | |
| 2010/0255752 | A1 | 10/2010 | McCafferty | |

FOREIGN PATENT DOCUMENTS

| | | |
|---|---|---|
| GB | 436912 | 10/1935 |
| WO | 02/24417 | 3/2002 |
| WO | 2006/133069 | 12/2006 |

OTHER PUBLICATIONS

PCT Intenational Preliminary Report on Patentability for PCT/US2011/001202.

PCT Intenational Search Report and The Written Opinion of the International Searching Authority for PCT/US2012/065702.

PCT International Preliminary Report on Patentability from PCT/US2012/065702, mailed on May 20, 2014.

* cited by examiner

100

LAUNCHER DEVICE FOR LAUNCHING A SERIES OF ITEMS INTO A SPIN

CROSS-REFERENCE TO RELATED APPLICATIONS

This is a non-provisional application of U.S. Provisional Application No. 61/540,458, filed on Sep. 28, 2011, and entitled, "Launcher."

BACKGROUND OF THE INVENTION (1) Field of Invention

The present invention relates to a toy launcher and, more particularly, to a toy launcher that can launch multiple consecutive items into a spin about an axis.

(2) Description of Related Art

Toy launchers have long been known in the art. Toy launchers are typically formed to launch an item aerially or upon a ground surface. By way of example, many launchers shoot items or aerial items into the air. Alternatively, other launchers are formed to launch a vehicle or other item upon a surface.

While such launchers "shoot" an item, they do not spin an item. More specifically, such launchers do not spin a non-spherically shaped item (e.g., a cylindrically-shaped item) about an axis.

Thus, a continuing need exists for a toy launcher that can launch into a spin a series of consecutive non-spherically shaped items.

SUMMARY OF INVENTION

A toy launcher that can launch multiple consecutive devices into a spin is described. The toy launcher includes a housing adapted to receive an item to be launched. The housing includes a launching mechanism to force the item from the launcher. Additionally, a protrusion is positioned in front of the launching mechanism such that as the item is forced from the launcher, a first end of the item catches with the protrusion to allow a second end of the item to speed forward and into a spin, thereby causing the item to be launched from the launcher while spinning about a short axis of the item.

In another aspect, the housing includes art upper tray and a bottom tray. Further, the bottom tray can be formed to include channels that receive raised edges of the item to be launched.

In yet another aspect, the launching mechanism includes a trigger handle that is operably connected with a compression lever, such that upon use of the trigger handle, the compression lever squeezes the item to be launched to force the item from the launcher.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a toy launcher and, more particularly, to a toy launcher that can launch multiple consecutive devices into a spin. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of ail such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figures 1A, 1B:
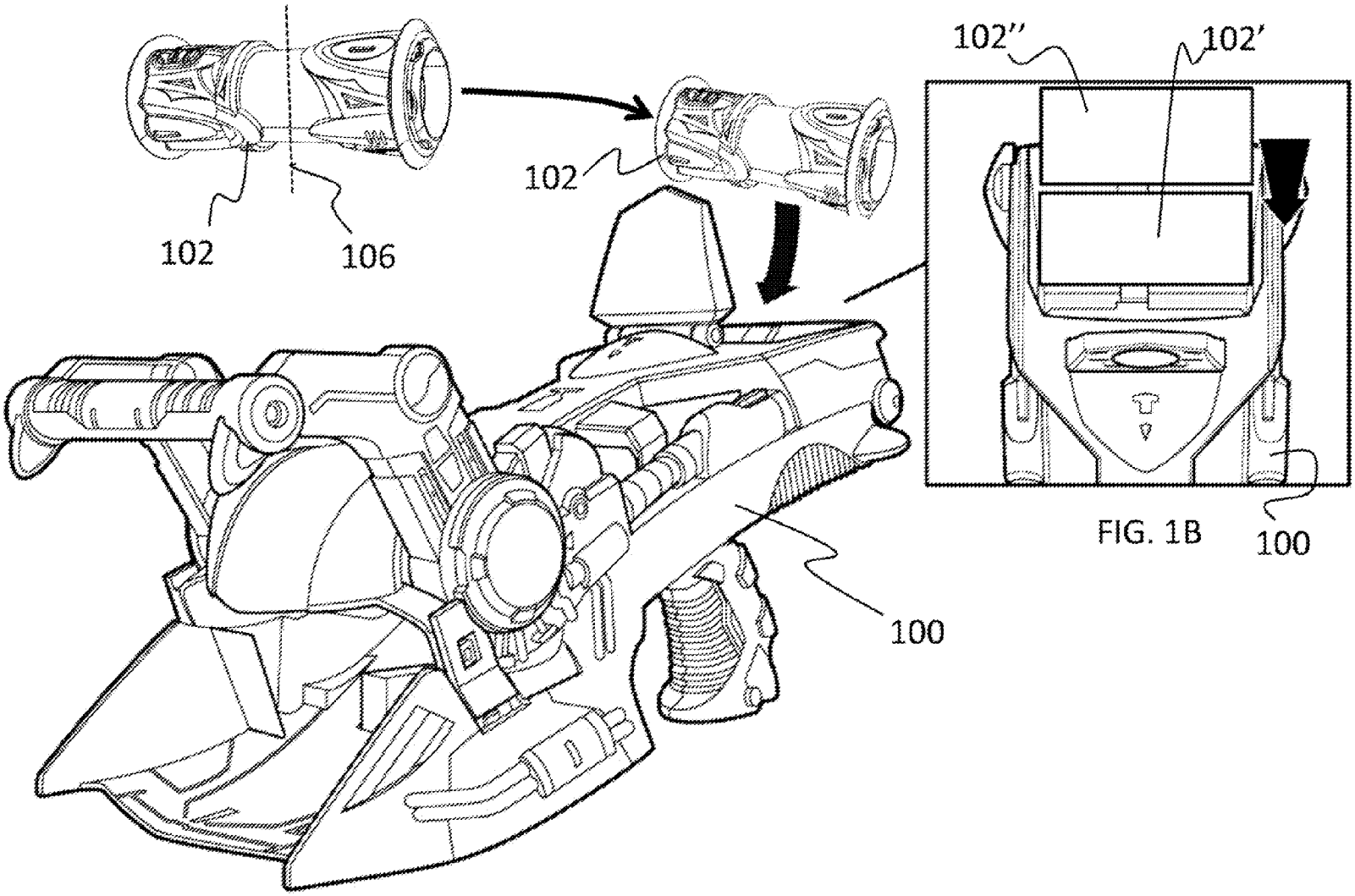
FIG. 1A is an illustration of a launcher with an item being positioned therein.
FIG. 1B is a rear-view illustration of the launcher, showing the item as being positioned into the launcher.

As shown in FIG. 1A, the present invention is directed to a launcher 100 that can launch multiple consecutive items 102 into a spin. In one aspect and as illustrated, the launcher 100 is formed to launch non-spherically shaped items 102 into a spin. It should be noted that although the item 102 is later depicted as a cylinder for illustrative purposes, it is not intended to be limited thereto. Instead, the item 102 is any suitably-shaped item that can be launched from the launcher such that it is forced into a spin to rotate around the short axis 106 of the item 102. FIG. 1B is a rear-view illustration of the launcher 100, showing a series of items 102' and 102" being loaded into the launcher 100. Thus, once the items 102 are loaded into the launcher 100, they can be launched therefrom and forced into a spin.

Figure 2:
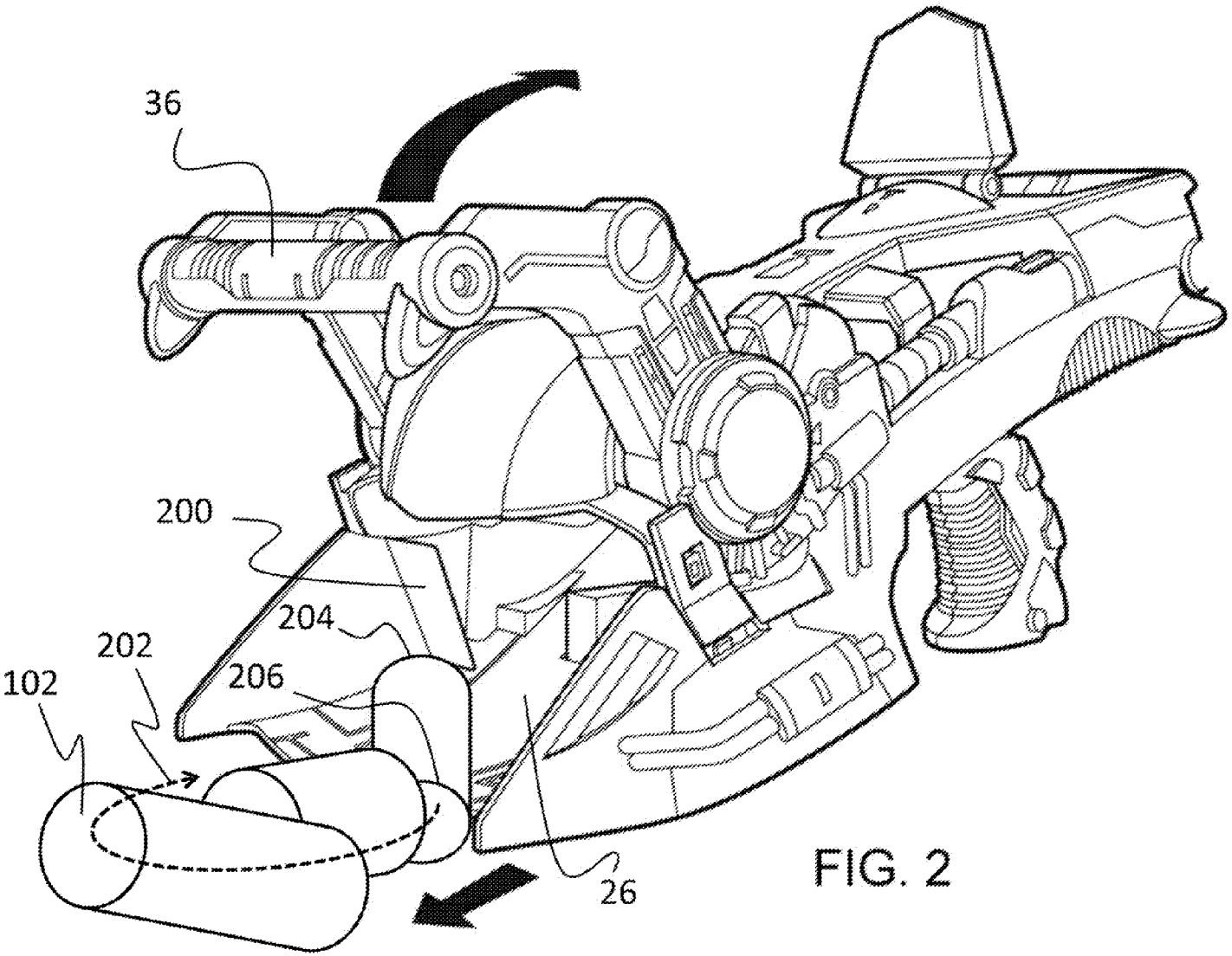
FIG. 2 is an illustration of a launcher, showing the item as being launched into a spin from the launcher.

While a barrel-shaped item or cylinder may have a round shape at its top or bottom edges, the launcher 100 does not simply spin the item to rotate about the circular peripheral edge. Instead and as shown in FIG. 2, the launcher 100 forces the item 102 lengthwise from the launcher 100, with one edge of the item catching a protrusion 200 in a bottom tray 26 to force the item 102 into the spin 202. As can be understood by one skilled in the art, there are many ways in which to design the launching mechanism of the launcher to force the item 102 from the launcher 100. In one aspect, the launcher 100 includes a trigger handle 36 that, when pulled back, forces a compression lever (depicted as element 14 in FIG. 3) to squeeze the item 102 and force the item 102 from the launcher 100. In this aspect, the compression lever actually pinches the item 102 against a bottom surface (e.g., bottom tray 26) of the launcher (such as a flat or ramp shaped surface) to squeeze the item 102 from the launcher 100. For example, the compression lever pinches the item against the bottom surface 26, which squeezes it out of the launcher 100. As it leaves the launcher 100, a first end 204 of the item 102 catches with the protrusion 200 to allow a second end 206 of the item to speed forward and into the spin 202. In another aspect, the launcher includes a kick-out item to essentially "flick" the item from the launcher.

Figure 3:
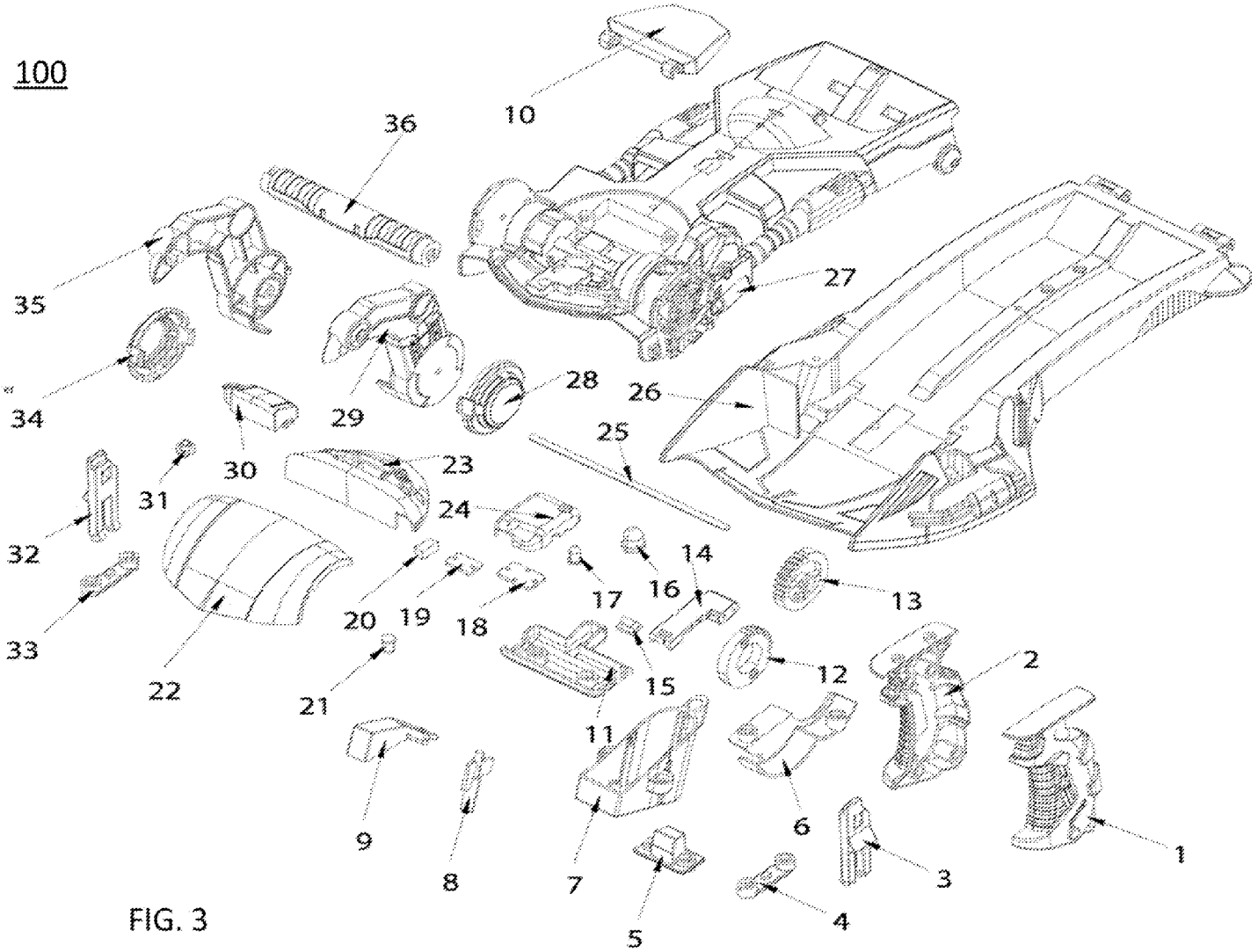
FIG. 3 is an exploded view illustration of the launcher, showing each of the corresponding components that collectively form the launcher.

For further understanding, FIG. 3 is an exploded-view illustration of the launcher 100, showing each of the corresponding components that collectively form the launcher 100. As noted above, there are several techniques by which a launcher 100 according to the present invention can be formed. Thus, the specific aspect as shown in FIG. 3 is but one non-limiting example of a launcher 100 according to the present invention. As shown, the launcher 100 includes the following components:

1. Handle left
2. Handle right
3. Left lock
4. Support part
5. Friction part
6. Gear cover
7. Safety lock housing
8. Safety lock release rod
9. Safety lock
10. Scope
11. Lower light clear cover
12. Trigger lever gear
13. Compression lever gear
14. Compression lever
15. Launcher tip
16. Light emitting diode (LED) cover
17. LED
18. Printed circuit board (PCB)
19. PCB
20. Micro switch
21. LED
22. Light cover
23. Battery compartment
24. LED top cover
25. Shaft
26. Bottom tray
27. Upper tray
28. Clear cover
29. Left pull trigger lever
30. Battery compartment cover
31. Nut cover
32. Right lock
33. Support part
34. Cover
35. Right pull trigger lever
36. Trigger handle As can be appreciated by one skilled in the art, the various components listed above are connected with one another using any suitable technique, such as being glued, screwed, etc., as the case may be and as applicable to the launcher 100 as depicted.

In operation, a user loads the items into a compartment that is formed between the upper tray 27 and lower tray 26. The items come to rest with a safety lock 9 that prevents the items from being launched from the launcher 100 when the launcher 100 is not positioned upon a ground surface. In other words, the safety lock 9 is positioned in the path of the items to prevent them from being launched from the launcher 100. The mechanism of the safety lock 9 is described in further detail below with respect to FIG. 5.

Once the item is loaded in the launcher 100 and the safety lock 9 is released, a user can launch the item from the launcher 100 using a trigger mechanism. Thus, the item includes a trigger mechanism that is connected with a compression lever 14 to force the item from the launcher 100. As a non-limiting example, the trigger mechanism includes a trigger handle 36 that is pivotally connected with the upper tray via the left and right pull trigger levers 29 and 30, respectively. At least one of the poll trigger levers, such as the left pull trigger lever 29, is connected to a trigger lever gear 32, which is engagingly connected with a compression lever gear 13. The compression lever gear 13 is connected with the compression lever 14, such that as a user pulls hack the trigger handle 36, the gears (trigger lever gear 12 and compression lever gear 13) cause the compression lever 14 to rotate downward and squeeze the item. Optionally, a launcher tip 15 (e.g., rubber tip) can be connected with the compression lever 14 to provide a pliable surface that compresses against the item to force the item from the launcher 100. Alternatively, the item can be formed such that the compression lever 14 alone (without the tip 15) operates to force the item from the launcher 100 (i.e., the tip is integrally formed as a single piece of plastic with the compression lever 14).

Various lights and electronic components can be included to provide visual effects to a user when operating the launcher 100. For example, batteries can be contained in the battery compartment 23 to power the various LED's 17 and 21, all of which can be operated via a micro switch 20 that is connected with the PCB's 18 and 19.

Figure 4:
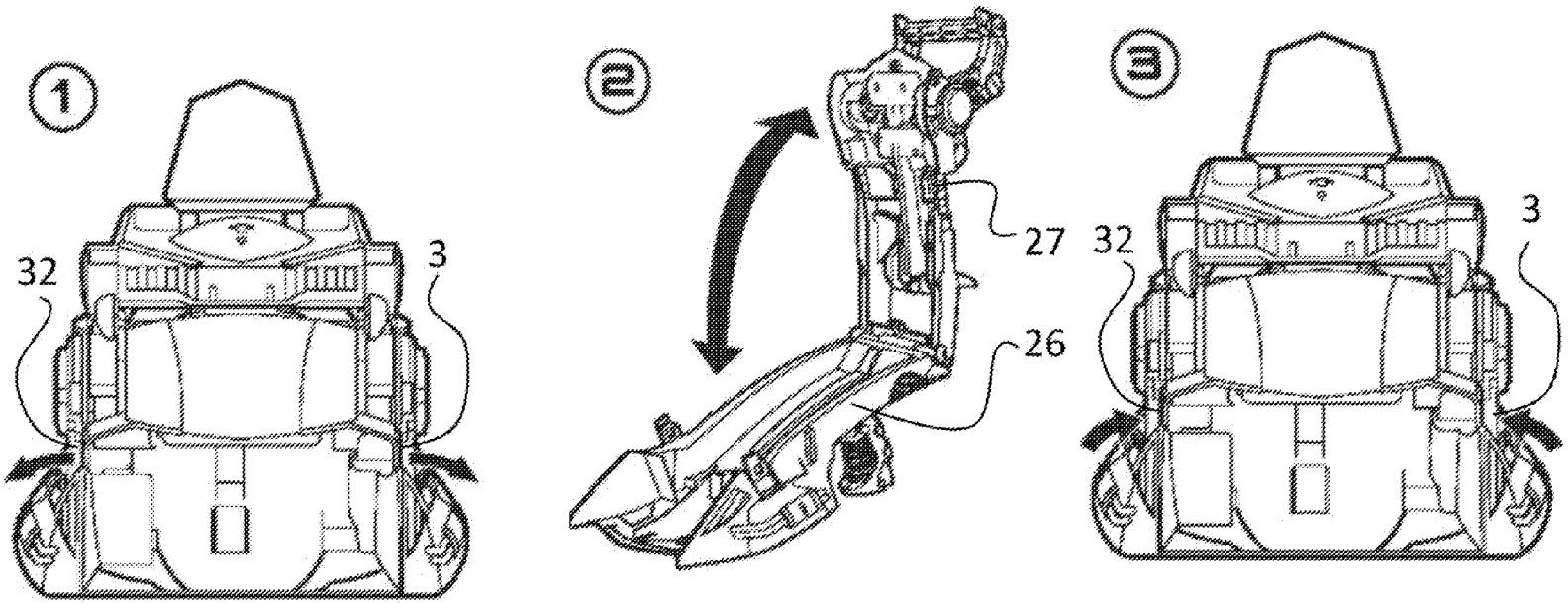
FIG. 4 is an illustration depicting a process by which the launcher can be opened to un-jam an item positioned therein.

It should also be noted that the upper tray 27 is pivotally connected with the lower tray 26 to allow a user to separate the trays and access the compartment formed therebetween. The trays 26 and 27 are locked together using the left and right locks 3 and 32, respectively. As shown in FIG. 4, when the left and right locks 3 and 32 are pulled out (shown in Step 1), the upper tray 27 is allowed to be pivoted up and away from the bottom tray 26 (show in Step 2). This is desirable if the items become jammed within the compartment. Thus, by unlocking and separating the trays 26 and 27, a user can un-jam the launcher. As shown in Step 3, after the upper tray 27 is snapped back onto the bottom tray 26, the locks 3 and 32 can be positioned back into place to lock the trays together.

Figure 5:
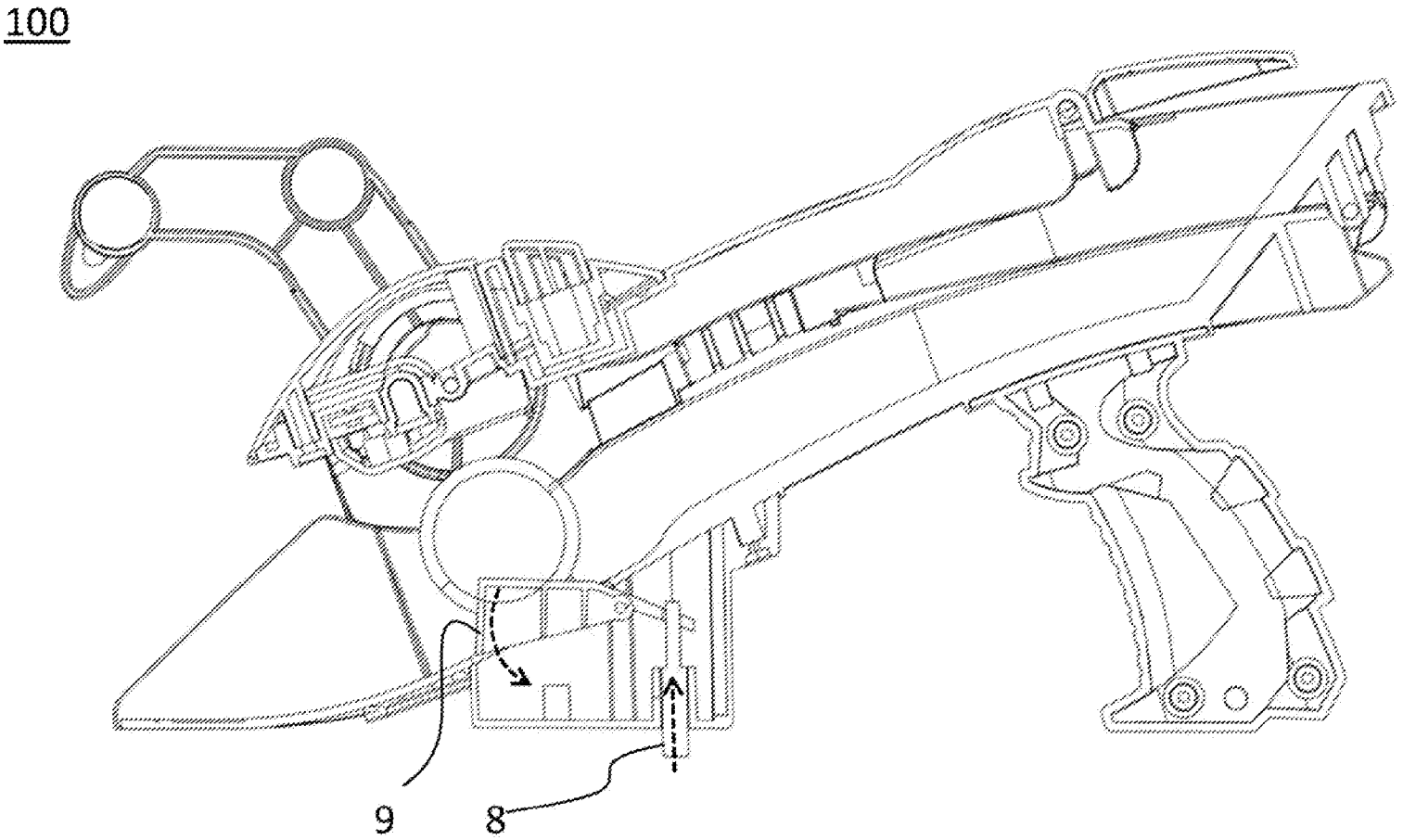
FIG. 5 is a left, cross-sectional view of the launcher.

FIG. 5 provides a left, cross-sectional interior view of the launcher 100. As mentioned above, the launcher 100 includes a safety lock 9 positioned in the path of the items to prevent them from being launched from the launcher 100. A safety lock release rod 8 is connected with the safety lock 9. When the launcher 100 is positioned upon a ground surface, the safety lock release rod 8 is forced upwards, which causes the safety lock 9 to pivot downwards and open the release path from the launcher 100.

Figure 6:
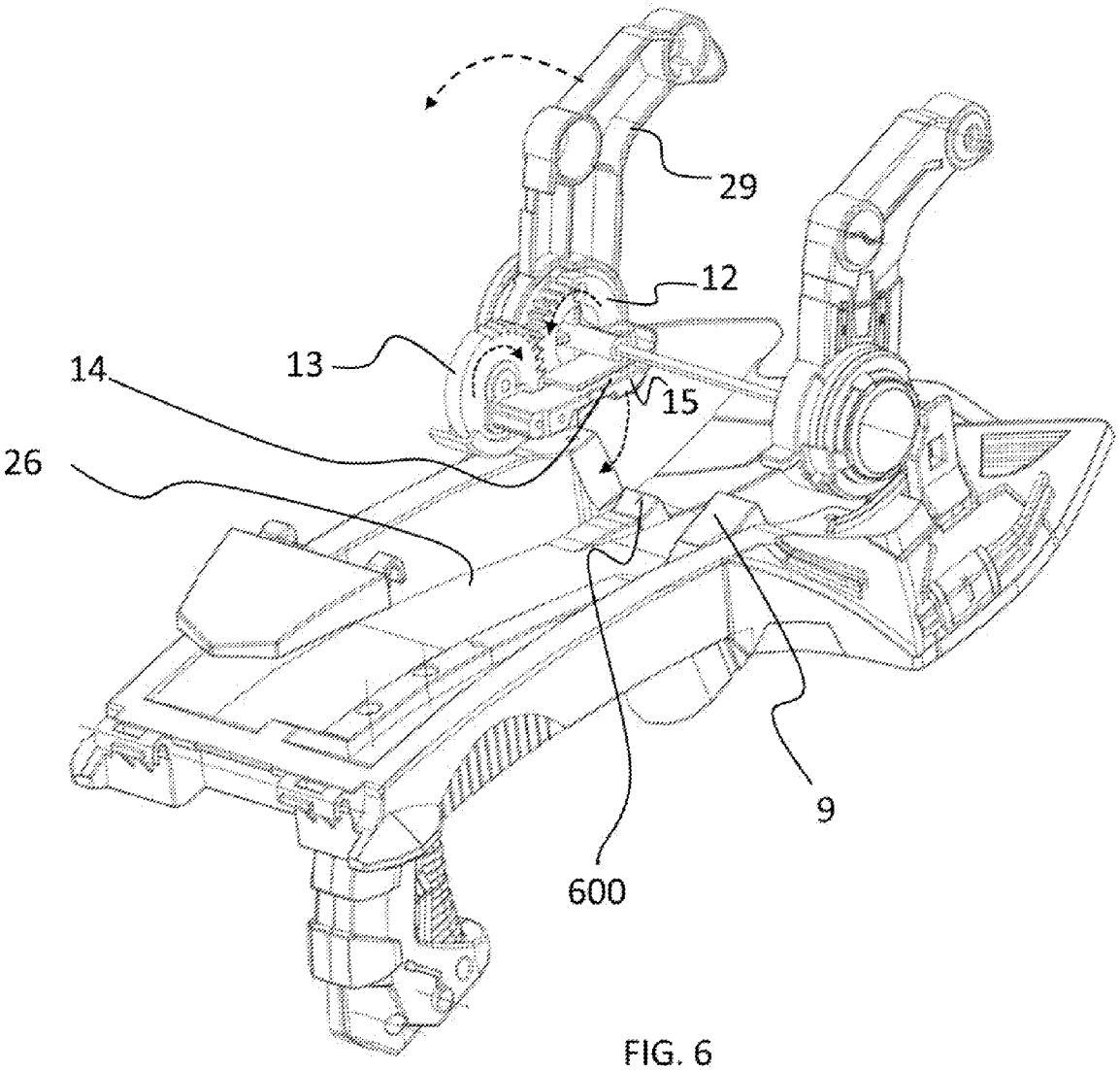
FIG. 6 is an elevated, right-rear interior view of the launcher.
Figure 7:
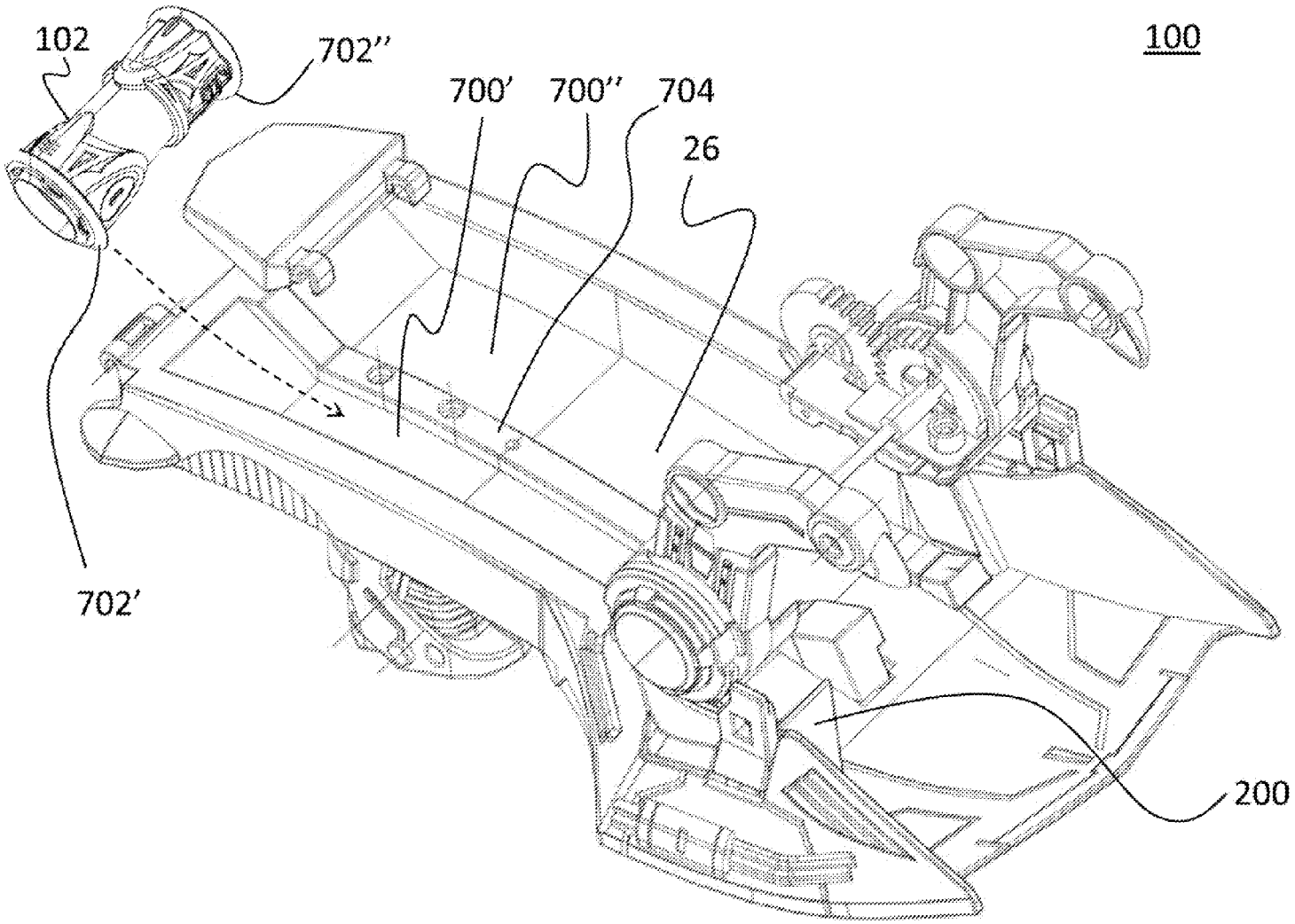
FIG. 7 is an elevated, right-front interior view of the launcher.

For further understanding of the interior functions of the launcher 100, FIGS. 6, 7, and 9 provide an elevated, right-rear interior view, an elevated, right-front interior view, and an elevated, left-rear interior view of the launcher 100, respectively.

As shown in FIG. 6, the left pull trigger lever 29 is connected to a trigger lever gear 12. Thus, pulling back the left pull trigger lever 29 causes the trigger lever gear 12 to rotate, which in turn rotates the compression lever gear 13. Rotation of the compression lever gear 13 causes the attached compression lever 14 to rotate downward and squeeze the item between the launcher tip 15 and the bottom tray 26. In this example, the bottom tray 26 includes a ramp-shaped feature 600. The ramp-shaped feature 600 serves to hold the item from rolling out of the launcher 100 when the launcher is positioned on a ground surface (as the safety lock 9 is moved out of the item's path in that circumstance). The ramp-shaped feature 600 also acts as a compression surface against which the item is compressed by the launcher tip 15. Thus, as the launcher tip 15 is forced downward, it squeezes the item between the launcher tip 15 and ramp-shaped feature 600 until the item is essentially squeezed (forced) from the launcher 100.

Figure 8:
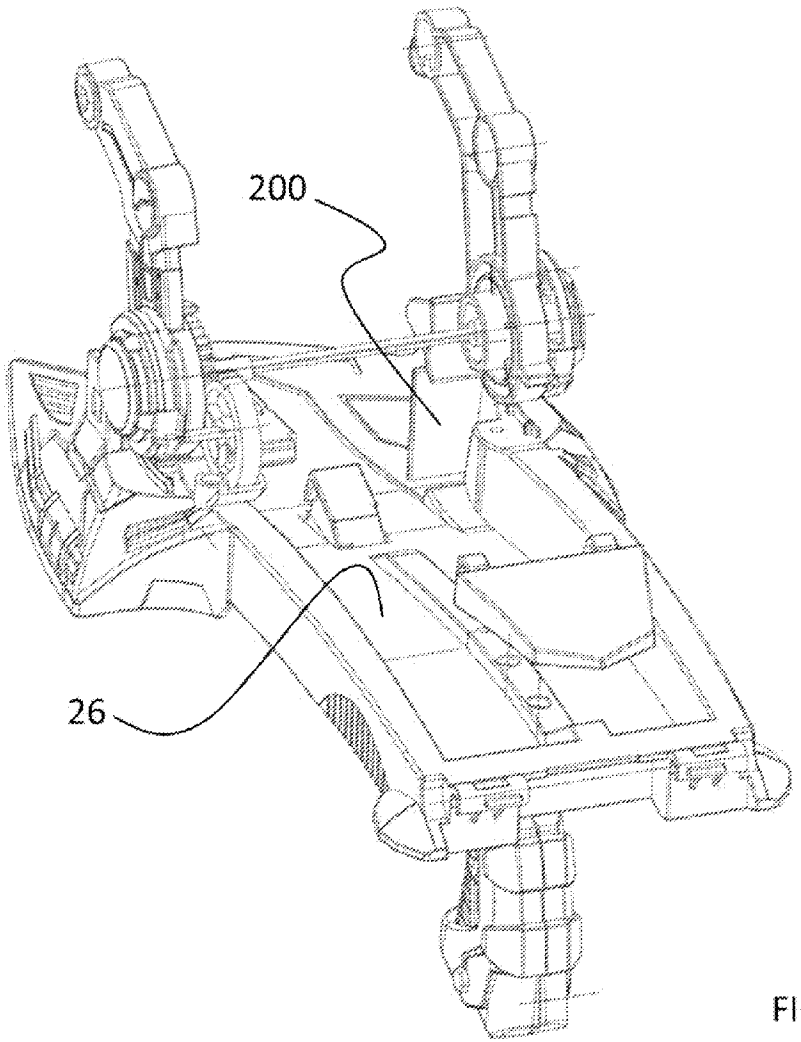
FIG. 8 is an elevated, left-rear interior view of the launcher.

As shown in FIGS. 7 and 8, as the item leaves the launcher 100, one side of the item comes into contact with the protrusion 200 in the bottom fray 26 to force the item into the spin. It should be understood that the protrusion 200 can also be formed in the upper tray and hung in the path of the exiting item. Thus, the invention is not intended to be limited to the actual component holding the protrusion 200 within the path of the item as the use of the bottom tray 26 is merely one non-limiting example by which a protrusion 200 can be appropriately positioned.

It should also be noted that the launcher 100 can be formed to direct the items into contact with the launcher tip 15 and, in doing so, prevent the items from rotating laterally or out of alignment with the tip 15 as they are maintained within the launcher 100. As a non-limiting example and as shown in FIG. 7, the bottom tray 26 can include channels 700' and 700" that are coordinated to receive raised edges 702' and 702" of the item 102. In this non-limiting example, the channels 700' and 700" are separated by a ridge 704 which helps to guide the item 102 and prevent the item from coming out of alignment when it is within the launcher 100.

Figure 9B:
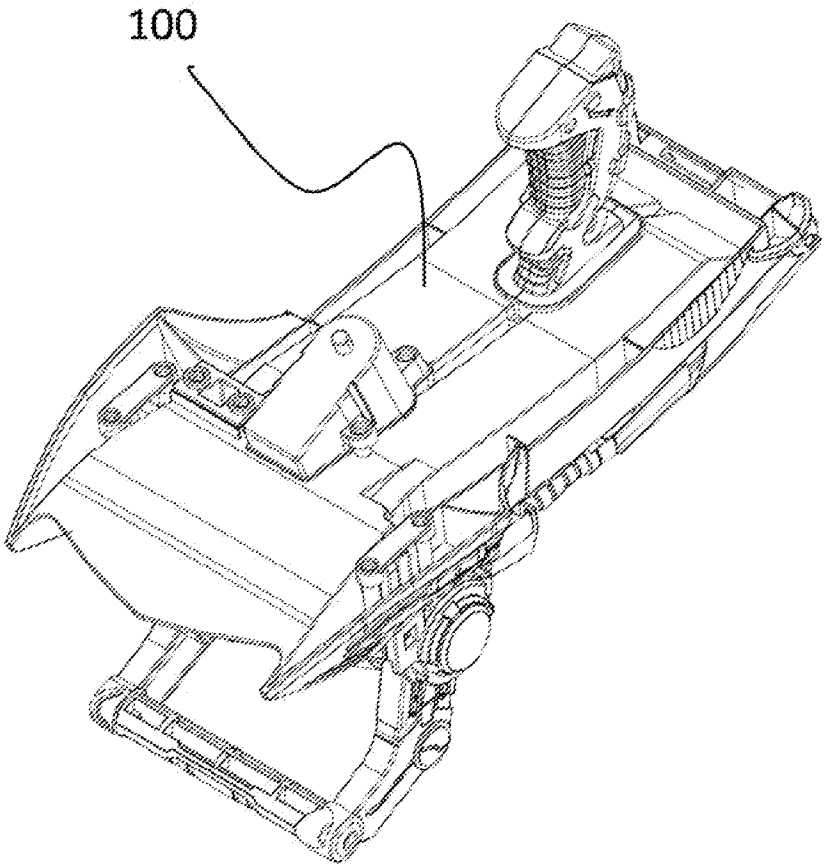
FIG. 9B is an elevated, bottom-left view of the launcher.
Figure 9A:
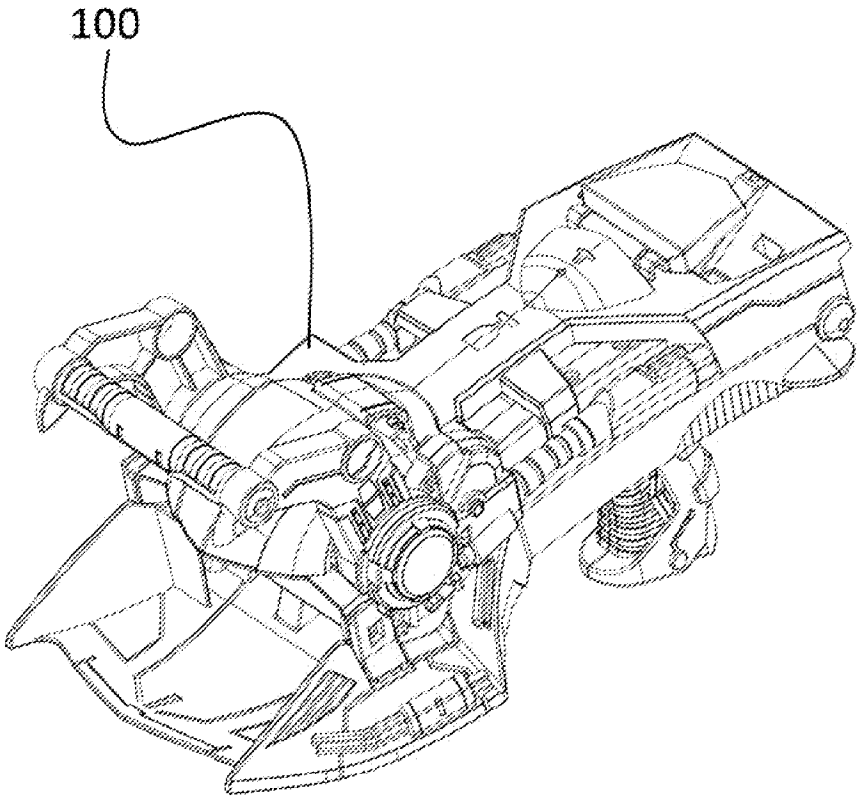
FIG. 9A is an elevated, front-left view of the launcher.

Finally and for further illustration, FIG. 9A is an elevated, front-left view of the launcher 100 and FIG. 9B is an elevated, bottom-left view of the launcher 100.

What is claimed is:

1. A toy launcher for launching an item into a spin, comprising:

a housing adapted to receive an item to be launched, the housing having a launching mechanism to force the item from the launcher;

a protrusion positioned in front of the launching mechanism such that as the item is forced from the launcher, a first end of the item catches with the protrusion to allow a second end of the item to speed forward and into a spin,thereby causing the item to be launched from the launcher while spinning about a short axis of the item;

wherein the housing includes an upper tray and a bottom tray;

wherein the launching mechanism includes a trigger handle that is operably connected with a compression lever, such that upon use of the trigger handle, the compression lever squeezes the item to be launched to force the item from the launcher; and wherein the bottom tray includes channels that are formed to receive raised edges of the item to be launched.

2. A toy launcher for launching an item into a spin, comprising:

a housing adapted to receive an item to be launched, the housing having a launching mechanism to force the item from the launcher;

a protrusion positioned in front of the launching mechanism such that as the item is forced from the launcher, a first end of the item catches with the protrusion to allow a second end of the item to speed forward and into a spin, thereby causing the item to be launched from the launcher while spinning about a short axis of the item;

wherein the housing includes an upper tray and a bottom tray; and wherein the bottom tray includes channels that are formed to receive raised edges of the item to be launched.

* * * * *